US008141296B2

(12) United States Patent
Bem

(10) Patent No.: US 8,141,296 B2
(45) Date of Patent: Mar. 27, 2012

(54) APPARATUS FOR AUTOMATICALLY OPENING AND CLOSING, LOCKING AND UNLOCKING BATHROOM STALL DOOR

(76) Inventor: Branko Bem, Plano, TX (US)

( * ) Notice: Subject to any disclaimer, the term of this patent is extended or adjusted under 35 U.S.C. 154(b) by 529 days.

(21) Appl. No.: 12/270,138

(22) Filed: Nov. 13, 2008

(65) Prior Publication Data

US 2009/0300988 A1 Dec. 10, 2009

Related U.S. Application Data

(60) Provisional application No. 61/059,924, filed on Jun. 9, 2008.

(51) Int. Cl.
*E05F 15/02* (2006.01)
*E05F 15/10* (2006.01)
*G08B 21/00* (2006.01)

(52) U.S. Cl. ..... 49/340; 340/686.6

(58) Field of Classification Search ..... 49/25, 31, 49/333, 334, 335, 340, 394, 236–239; 16/309; 318/400.4; 340/3.1, 545.1, 686.1; 4/300, 4/314; 70/101
See application file for complete search history.

(56) References Cited

U.S. PATENT DOCUMENTS 3,954,292 A 5/1976 Johnson
3,967,478 A 7/1976 Guinn
5,299,862 A * 4/1994 Rankine ..... 312/329
5,855,027 A * 1/1999 Macedo ..... 4/405
6,353,971 B1 3/2002 Krawczyk
6,568,231 B1 5/2003 Huang
6,634,140 B1 10/2003 Sellman
6,644,077 B1 11/2003 Huang
6,891,479 B1 5/2005 Eccleston
6,967,587 B2 * 11/2005 Snell et al. ..... 340/686.6
7,068,179 B2 6/2006 Snell et al.
7,310,911 B1 12/2007 Sellman
7,352,274 B2 4/2008 Omata et al.
2002/0116788 A1 * 8/2002 Pompei ..... 16/315
2004/0244293 A1 * 12/2004 Eckel et al. ..... 49/334
2007/0056084 A1 * 3/2007 Watt et al. ..... 4/246.1
2010/0253516 A1 * 10/2010 Lemerand et al. ..... 340/545.1
2011/0080252 A1 * 4/2011 Ibsies ..... 340/3.1

* cited by examiner

*Primary Examiner* — Katherine W Mitchell
*Assistant Examiner* — Jeremy Ramsey
(74) *Attorney, Agent, or Firm* — Michael Diaz

(57) ABSTRACT

An apparatus and system for automatically opening and closing a bathroom stall door. The system includes a motor for driving the door open or closed. A control unit controls the operation of the motor. An outer activation sensor senses a presence of a person in proximity to the outer activation sensor. Upon sensing a presence of a person in proximity to the outer activation sensor by the outer activation sensor, the control unit commands the motor to open the door and automatically close the door after a predetermined time period. When an inner activation sensor senses a presence in the proximity to the inner activation sensor, the control unit locks the door lock. When the inner activation sensor senses a presence in proximity to the inner activation sensor a second time, the control unit unlocks the door lock and commands the motor to open the door.

20 Claims, 6 Drawing Sheets

APPARATUS FOR AUTOMATICALLY OPENING AND CLOSING, LOCKING AND UNLOCKING BATHROOM STALL DOOR

RELATED APPLICATIONS

This application claims the priority date of Provisional Patent Application Ser. No. 61/059,924 filed Jun. 9, 2008 under the name of Branko Bem and is hereby incorporated by reference herein.

BACKGROUND OF THE INVENTION

1. Field of the Invention

This invention relates to doors. Specifically, and not by way of limitation, the present invention relates to an apparatus for automatically opening and closing, locking and unlocking a bathroom stall door.

2. Description of the Related Art

There are numerous health concerns related to using public restrooms. A high concentration of germs in small areas represents a threat to personal hygiene and health. Even the most effective maintenance cannot guarantee complete sanitation on a regular basis. As a consequence, people either often avoid using public restrooms, unless in extreme necessity, or avoid contact with any type of germs. For example, many people kick open and close bathroom doors, wrap their hands in paper towels or toilet paper, or wait for another person to open the door so they can rapidly walk through the door before it closes. Consequently, the management of the public restrooms is faced with repairing plugged toilets, fixtures worn out in a shorter period of time, or liability due to personal injuries. An apparatus is needed which enables a person to easily open and close, as well as lock and unlock a bathroom stall door without requiring the person to actually touch the door.

It would be advantageous to have an apparatus for automatically open and close, lock and unlock a bathroom stall door without requiring a person to touch the door. It is an object of the present invention to provide such an apparatus.

SUMMARY OF THE INVENTION

In one aspect, the present invention is directed to an apparatus and automated system of touchless opening and closing, as well as locking and unlocking a bathroom stall door. A control unit of the apparatus has wireless capability that allows communication with other intelligent apparatus, sensors, control panels, status panels and terminals. The system includes a door covering a bathroom stall. The system also includes a motor for driving a door open or closed. The control unit controls the operation of the motor. The system also includes an outer activation sensor for sensing a presence of a person in proximity to the outer activation sensor, which is located on an outer surface of the bathroom stall door. Upon sensing a presence of a person in proximity to the outer activation sensor by the outer activation sensor, the control unit commands the motor to open the door and automatically closes the door after a predetermined time period. The system also includes an inner activation sensor for sensing a presence of a person in proximity to the inner activation sensor. The inner activation sensor is located on an inner surface of the bathroom stall door. When the inner activation sensor senses a presence in proximity to the inner activation sensor, the control unit commands the motor to open the door. In addition, the system includes a device which automatically locks the door when the stall is occupied and unlocks the door when a presence of the person is detected near the inner activation sensor. If the bathroom stall is vacant, the door stays in a crack-open position and only the outer activation sensor is active. Otherwise, only the inner activation sensor is active in order to prevent other persons from entering the bathroom stall.

In one embodiment, the door may be manually operated to allow the opening and closing, locking and unlocking of the door manually.

In another embodiment, the system may also include an indicator which automatically indicates when the stall is occupied.

DESCRIPTION OF THE INVENTION

Figure 1:
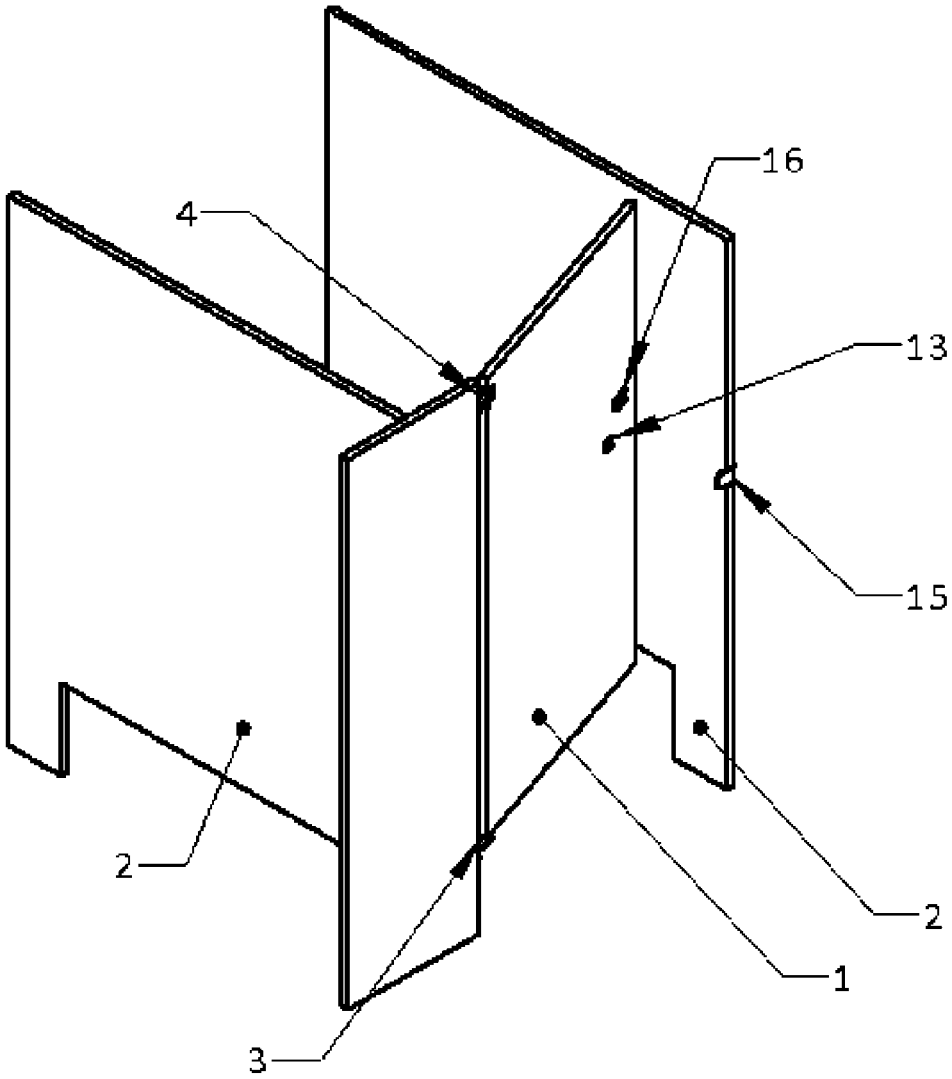
FIG. 1 is a top perspective view of a bathroom stall door in the preferred embodiment of the present invention.

The present invention relates to an apparatus for automatically opening and closing, as well as locking and unlocking a bathroom stall door. FIG. 1 is a top perspective view of a bathroom stall door 1 in the preferred embodiment of the present invention. The bathroom stall door 1 covers a bathroom stall having stall partition walls 2. The bathroom stall door 1 is rotated about a motorized gravity coupled slanted hinge 3 and a slide hinge 4. A door stop 15 includes a door status position feature, such as a magnet, flag or boss to activate a door close sensor 19 (see FIG. 3). The door close sensor 19 may be an optical sensor, hall effect, reed switch, a mechanical switch or any type of sensor communicating with a control unit 14 (see FIG. 3) that the door 1 is closed. In addition, a door occupancy status light indicator 16 may be affixed to an outside surface of the door to indicate if the stall is occupied. An outer activation sensor 13 may be affixed on or near the door 1. The outer activation sensor 13 may be an optical sensor, proximity capacitance, or motion sensor which is located on the front side of the door or in proximity to the front side of the door. In the preferred embodiment of the present invention, the outer activation sensor 13 is located at a location of a door latch on a traditional door to enable activation of the door by a person of any height or by a disabled person and is preferably in full compliance with the American Disabilities Act (ADA).

Figure 2:
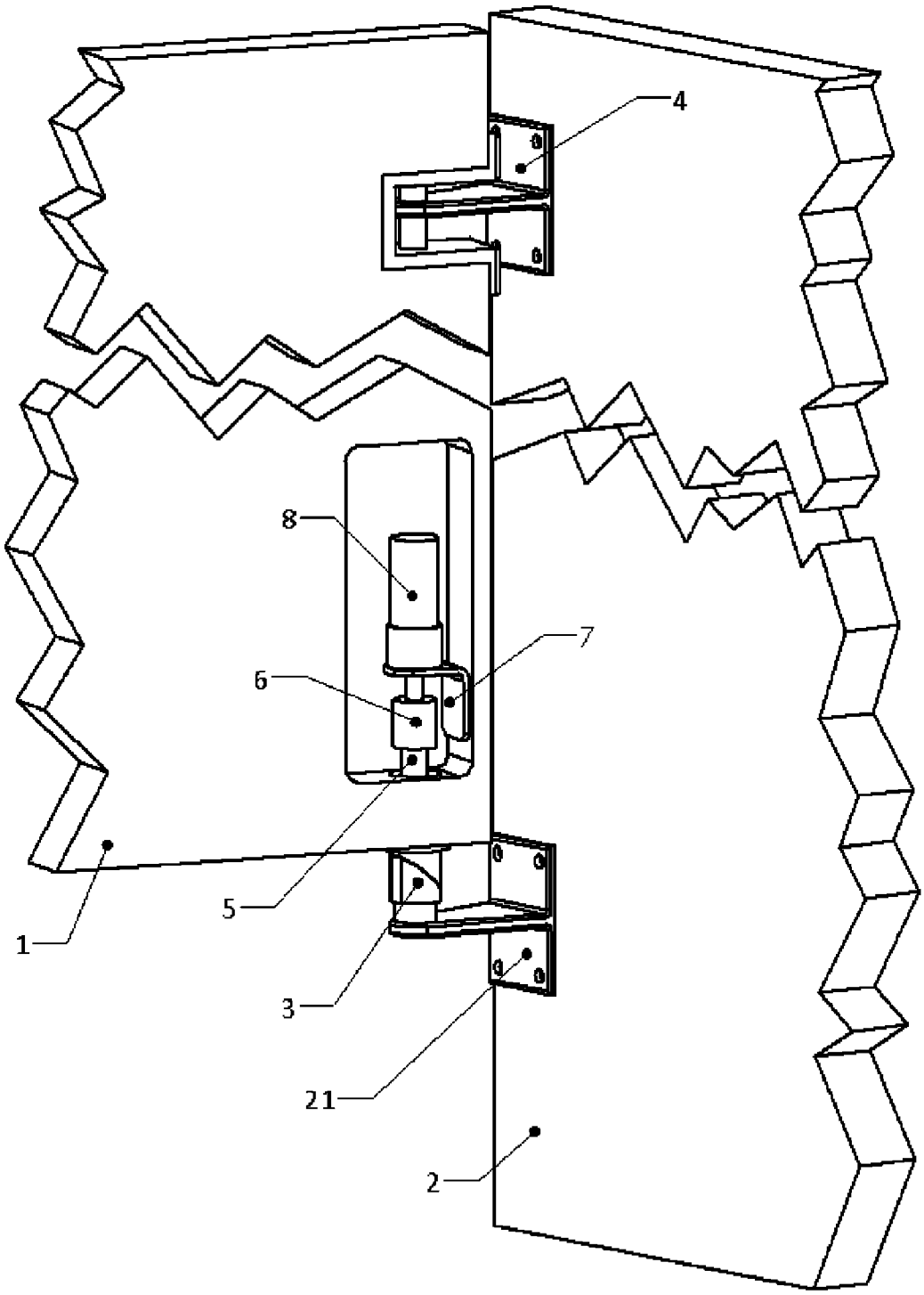
FIG. 2 is an inside perspective view of the stall door of FIG. 1.

FIG. 2 is an inside perspective view of the bathroom stall door 1 of FIG. 1. As discussed above, the bathroom stall door 1 is attached to one of the stall partition walls 2 with a slide hinge 4 and motorized gravity coupled slanted hinge 3. The present invention includes a gear head motor 8 which is affixed to the inside of the door 1 with a bracket 7. The gear head motor 8 may be an Alternating Current (AC), Direct Current (DC), or a servo motor. The shaft of the motor 8 is coupled with a coupler 6 to a gravity coupled slanted hinge shaft 5 that allows one side of the gravity coupled slanted hinge 3 to rotate. An opposing second side of the gravity coupled slanted hinge 3 is permanently fixed to a hinge bracket 21. A door actuator comprises the gravity coupled slanted hinge shaft 5, the coupler 6, the bracket 7 and the gear head motor 8. During activation, the door actuator rotates one side of the gravity coupled slanted hinge 3, thereby forcing the door 1, due to gravity force, to follow the hinge rotation. In the event that manual force is desired to open the door, the top slide hinge 4 allows an up and down motion (i.e., vertical motion) of the door, which decouples the door from the gravity coupled slanted hinge 3, thereby allowing the door 1 to be stopped, opened or closed independently from automatic operation. In addition, the hinges may be used as electrical connector for supplying power to the door.

Figure 3:
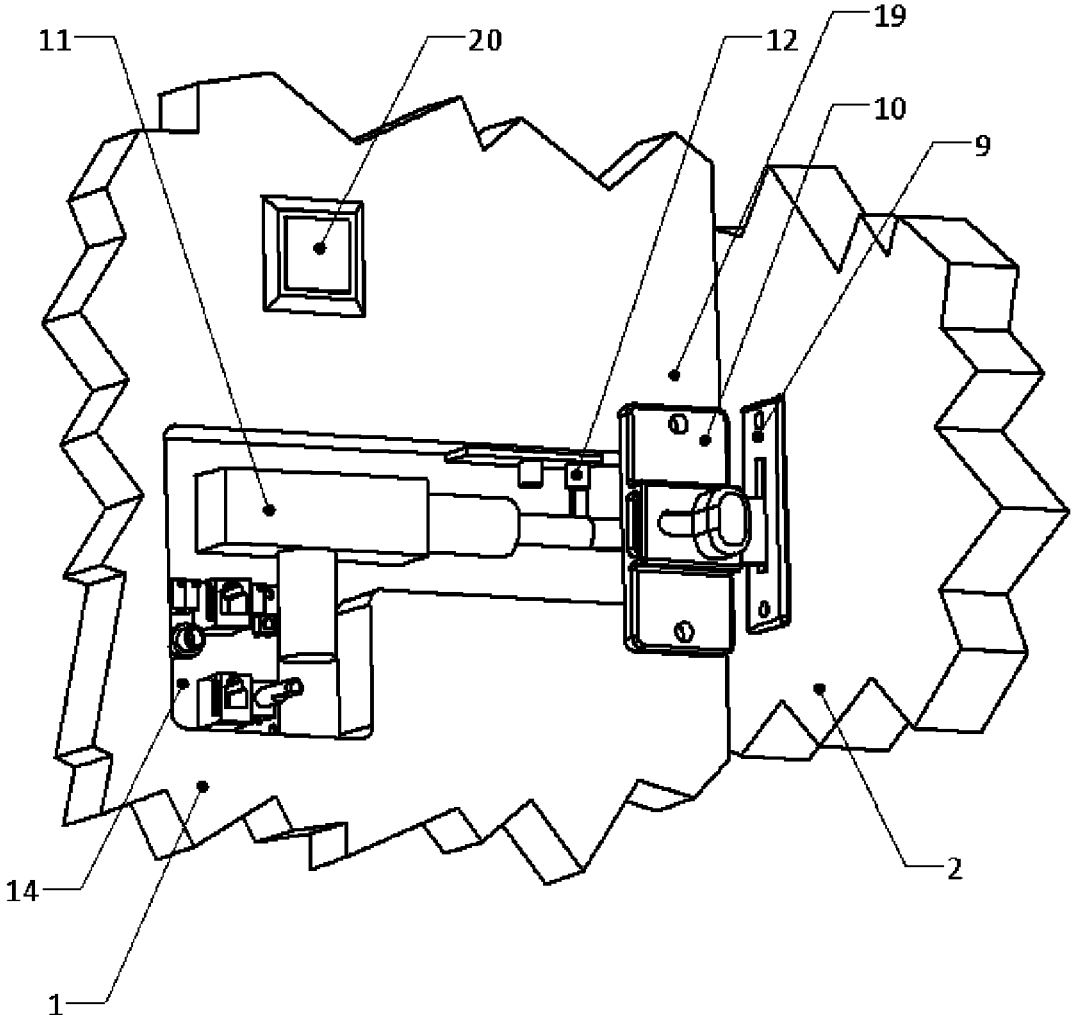
FIG. 3 is a front perspective view of an automatic door lock, sensors and control unit on the door of FIG. 1.

FIG. 3 is a front perspective view of an automatic door lock 10, control sensors and control unit 14 inside the door 1 of FIG. 1. The door lock 10 is linked to a linear or rotary lock actuator 11 located inside the bathroom stall door 1. A lock strike 9 is mounted on the wall partition 2. The lock strike 9 includes an elongated vertical slot to allow manual operation independently from the motorized gravity coupled slanted hinge 3. A lock and unlock position sensor 12 and the door close sensor 19 allow the control unit 14 to self-recover in case of manually interrupted operation. An inner activation sensor/status indicator 20 may be affixed on or in the proximity of the inner side of the door 1 or on the wall. The activation sensor may be an optical sensor, proximity capacitance, or a motion sensor. Status indicator 20 shows the door lock status. After detecting a person in the bathroom stall, the inner activation sensor/status indicator 20, located on the inside of the door 1, activates, which then locks the door 1. If the inner activation sensor/status indicator 20 does not detect a person in the stall in a predetermined period of time, the door returns to an initial crack-open position, indicating that the stall is vacant and the outer activation sensor 13 is activated. The power is immediately disconnected from the lock actuator 11 and gear head motor 8 after completion of actuation, thereby allowing manual lock operation. Additionally, disconnecting the power contributes to the saving of energy resources. In the preferred embodiment of the present invention, the control unit 14 and all its electrical components are held in a hibernate state, but wake up approximately every half second to detect a change in the status. Interruption by an outer activation sensor will also wake up the control unit 14. Being in a hibernating state most of the time greatly reduces power consumption, thereby allowing battery operation (not shown) of the present invention. A wireless module (not shown) in the control unit may communicate with other intelligent devices, sensors, or control terminals allowing full integration of the present invention with other devices associated with the bathroom stall.

The control unit 14 includes a control processor, memory, drivers, and optional wireless communication module. The control unit and any of its components preferably operate with low voltage to prevent electrical shock. The control unit 14 manages the entire operation of the present invention. Although depicted as being affixed to the inner side of the door 1, the control unit may be located anywhere in proximity to the stall.

Both the outer activation sensor 13 and the inner activation sensor 20 are located on the outside and inside of the door or in door's proximity at a height that preferably complies with ADA standards. Activation sensors may be optical, proximity capacity sensor, motion sensor, etc. If the bathroom stall is vacant, only the outer activation sensor 13 is active. If the stall is occupied, only the inner activation sensor 20 is active to prevent other persons from entering the bathroom stall.

Door opening, closing and positioning is accomplished by utilizing the gear head motor 8 coupled to the coupler 6 and the gravity coupled slanted hinge shaft 5. One side of the gravity coupled slanted hinge shaft 5 is fixed to the coupler 6 and the other side of the hinge is attached to the hinge bracket 21. Rotation of the one side of the hinge translates to door rotation by gravitational force from the rotation of the door actuator. This type of activation creates the minimal rotation force and minimizes accidental impact to a person or obstacles. Gravitational coupling of the hinge allows manual operation of the door even while the door is being automatically actuated. Immediately after the actuation, power is disconnected from the actuator 11 in order to save energy and to preserve electrical components. Low power to electrical components may be connected through the hinges in order to simplify the wiring. When the bathroom stall is vacant, the actuator positions the door in a cracked-open position, which indicates that the bathroom stall is vacant.

Figure 4:
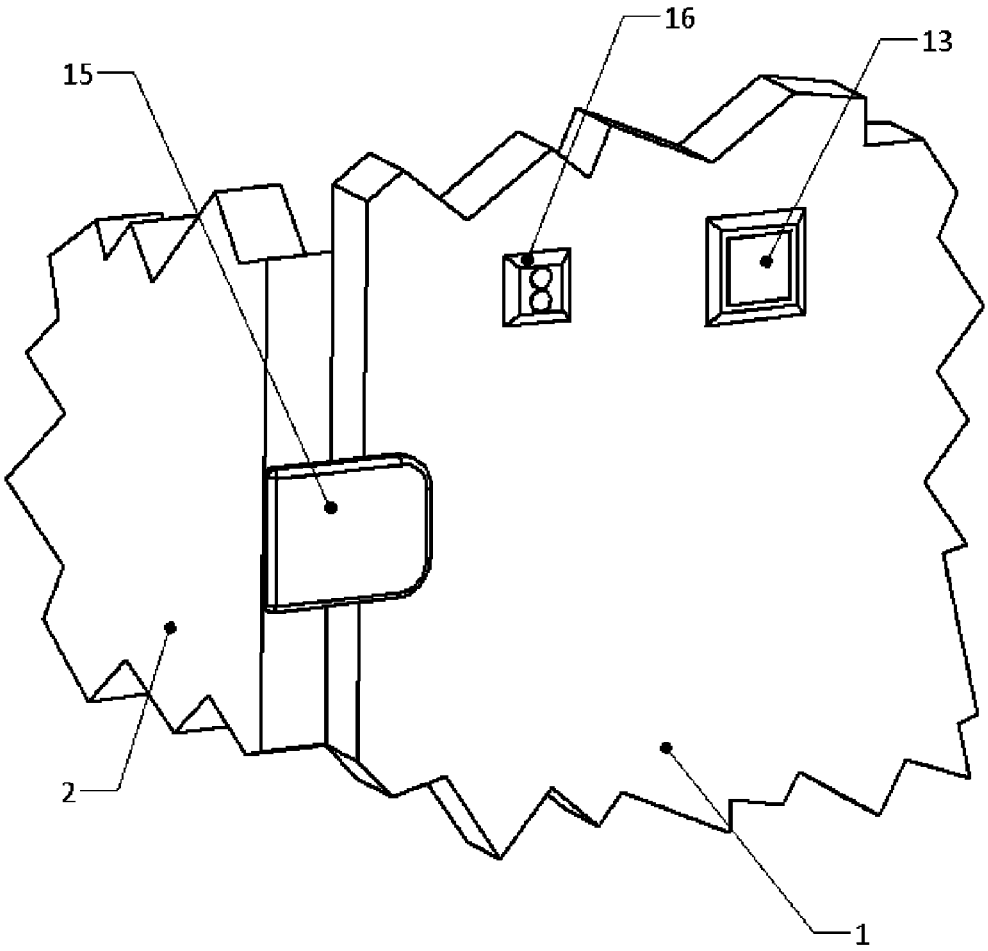
FIG. 4 is an enlarged perspective view of the outside of the stall door of FIG. 1 illustrating the door occupancy status light indicator.
Figure 5:
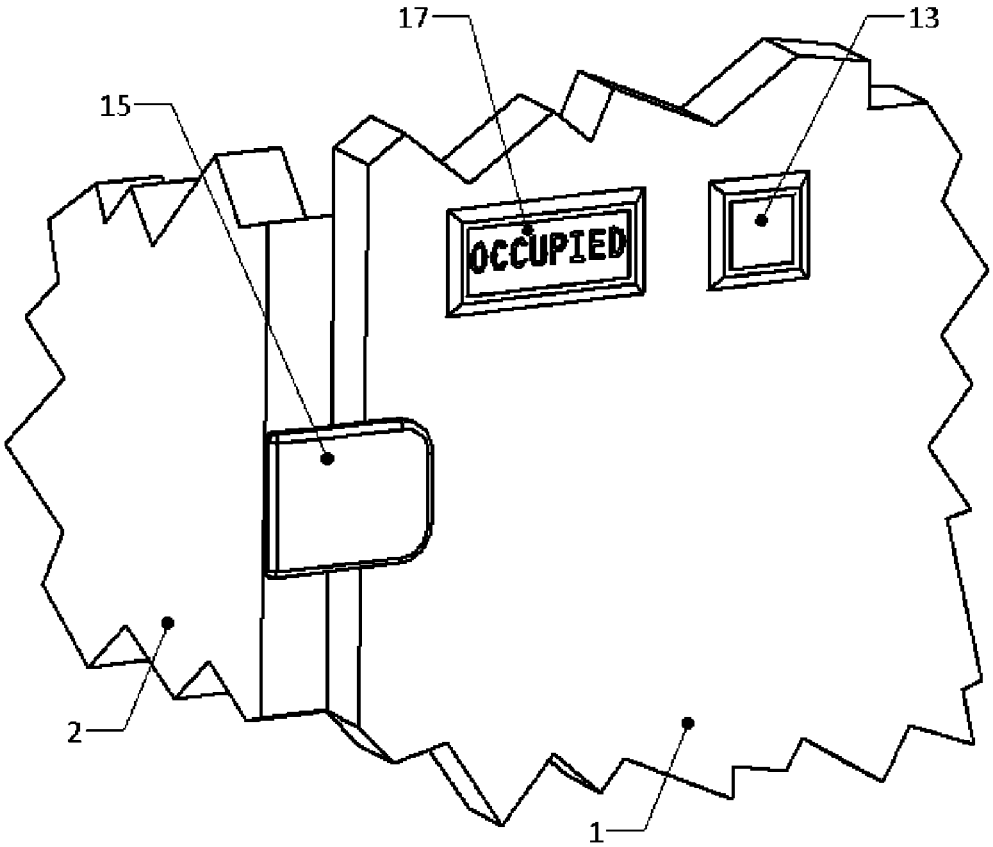
FIG. 5 is an enlarged perspective view of the outside of the stall door having a digital display in an alternate embodiment of the present invention.
Figure 6:
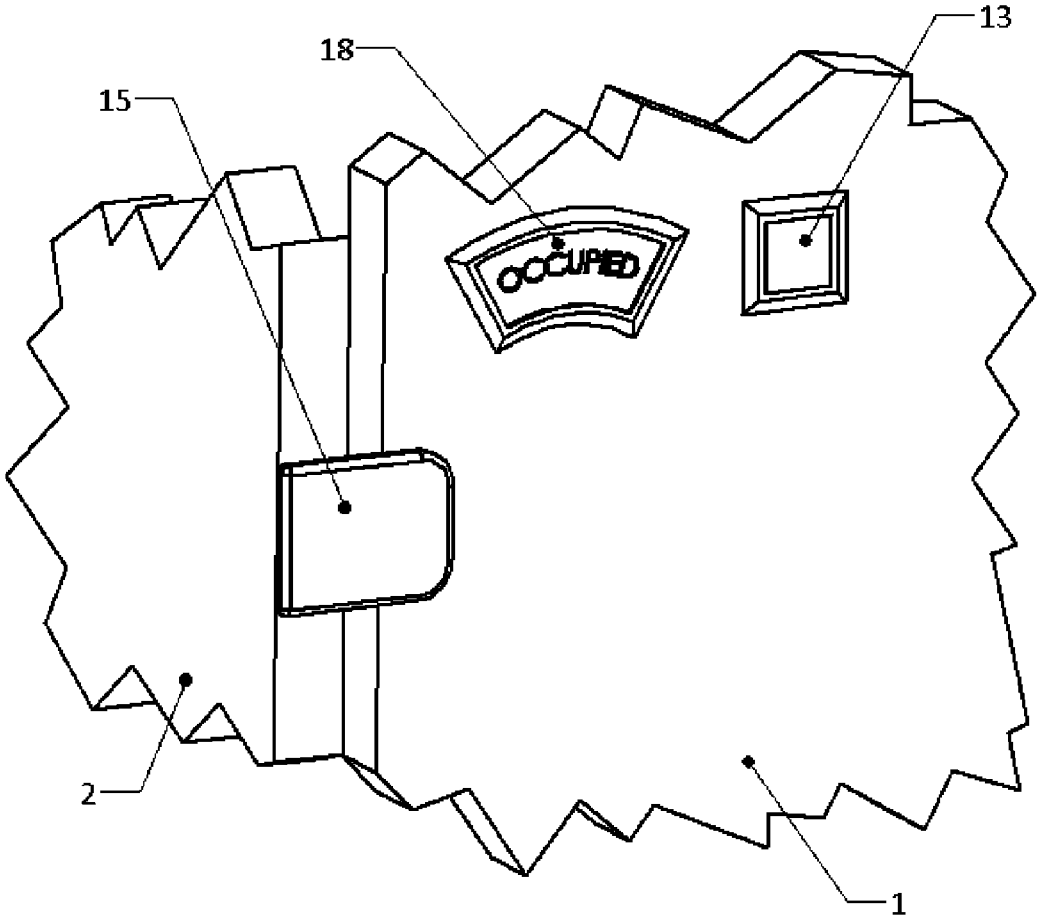
FIG. 6 is an enlarged perspective view of the outside of the stall door having a mechanical sign in a second alternate embodiment of the present invention.

FIG. 4 is an enlarged perspective view of the outside of the stall door 1 of FIG. 1 illustrating the door occupancy status light indicator 16. In this embodiment, the indicator 16 may include two or more lights (e.g., light emitting diode (LED) lights) to indicate that the stall is vacant (e.g., green light) or occupied (e.g., red light). Any illumination devices may be utilized to illuminate the light indicator. FIG. 5 is an enlarged perspective view of the outside of the stall door 1 having a digital display 17 in an alternate embodiment of the present invention. In this embodiment, the digital display may utilize a liquid crystal display (LCD) or other type of digital display for displaying a textual message (e.g., "vacant", "occupied", or "out of order"). Any illumination devices may be utilized to display the textual message. FIG. 6 is an enlarged perspective view of the outside of the stall door 1 having a mechanical sign 18 in a second alternate embodiment of the present invention. To indicate occupancy, the mechanical sign may include two select labels to indicate vacant or occupied. It should be understood, that any indicator may be utilized to indicate whether the stall is occupied and is not limited to the indicators displayed in FIG. 4, 5, or 6.

With reference to FIGS. 1-6, the operation of the present invention will not be discussed. Prior to a person approaching the stall, when the stall is vacant, the actuator positions the door 1 to a cracked-open position, which indicates that the bathroom stall is vacant. Furthermore, an indication by the occupancy status indicator 16, 17, or 18 is provided to indicate if the stall is vacant or occupied. If the stall is occupied, the door is locked fully closed and the occupancy status indicator provides an indication that the stall is occupied.

If the stall is vacant, as the person approaches the stall, the outer activation sensor 13 senses the presence of the person. As discussed above, the outer activation sensor 13 may be any type of sensor which senses the presence of a person, such as an optical sensor, proximity capacitance, or motion sensor which is located on the outer side of the stall door 1. Upon detecting the person near the stall, the system is activated. The door automatically opens by the gear head motor 8 driving the stall door 1 to the open position. Following a brief delay, the control unit 14 commands the door to close by actuating the gear head motor 8 to drive the stall door 1 to the closed position. In addition, if the inner activation sensor 20 senses the presence of a person, the door lock is automatically locked. In addition, the control unit commands the outer activation sensor 13 to an inactive state. The inner activation sensor 20 remains in an active state to sense any person near the inner sensor 20. In addition, the occupancy status indicator 16, 17, or 18 displays the stall as being occupied. When the person is finished with the use of the stall, the person approaches the inner activation sensor 20 (e.g., stands near the sensor 20), whereby the sensor 20 senses the person. The system is then activated in which the control unit 14 commands the stall door 1 to be unlocked and opened. The door look is unlocked and then opened, followed by the gear head motor 8 driving the stall door 1 to the open position, thereby allowing the person to exit the stall. Subsequent to a preset delay time, the gear head motor 8 moves the stall door 1 to the cracked-open position and the status indicator displays a vacant indication.

In one embodiment, if a person's presence is detected by the outer activation sensor 13, thereby opening the stall door 1, but the person does not enter after a predetermined time, the stall door 1 automatically returns to the cracked-open position indicating vacancy.

The control unit 14 may optionally keep track of the bathroom stall use frequency to provide accurate information for the purpose of appropriate service and maintenance schedule of the bathroom stall, as well as to indicate unusually prolonged use of the bathroom stall for safety and security purposes. If the bathroom fixtures are equipped with wired or wireless sensors, the control unit may communicate with maintenance, service, and/or a security terminal to report various conditions of the stall, such as if the bathroom stall is out of toilet paper, if there is a flood, or if help is needed by the person in the bathroom stall. Additionally, with or without communication with external systems, the control unit may be able to activate disinfection and deodorant dispensers and flush the toilet if it was not executed by the last person occupying the bathroom stall. The present invention may utilize the control unit to collect data, store data in a non-volatile memory and wirelessly transmit data to an external terminal.

The present invention provides an apparatus for the automatic opening and closing of a bathroom stall door, automatic door locking and unlocking, and the ability for a person to manually override all automatic functions and have full control of the operation of the door. Automated door can independently recover from manual operation and resume full automatic operation at any state; e.g. when person manually opens the door, enters the stall, and locks the door, controller puts automated door in automatic unlocking and door opening state. An optional wireless capability of the control unit may allow communication to other intelligent apparatus, sensors, control panels, and status panels and terminals. The present invention contributes to the elimination of potential health hazards people may encounter in public restrooms. The present invention eliminates all activities where a person must touch a bathroom stall door and thus reduces the spread of germs. The present invention intends to fully comply with ADA standards for bathroom fixtures. In addition, the present invention improves access to the bathroom stall for disabled person and provides better maneuverability. In addition, the present invention may be incorporated into existing bathroom stalls.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus for automatically opening and closing a bathroom stall door, the apparatus comprising:

a gravity coupled slanted hinge for driving a door open or closed, the door covering a bathroom stall;

wherein the gravity hinge forces the door to open or close due to gravity and position of the gravity hinge;

a motor for rotationally positioning the gravity hinge for opening and closing the door;

an automatic door lock attached to the door for preventing entry of the stall from outside the stall;

a control unit for controlling the motor and automatic door lock;

an outer activation sensor for sensing a presence of a person in proximity to the outer activation sensor, the outer activation sensor located on an outer surface or in the proximity of the bathroom stall door; and an inner activation sensor for sensing a presence of a person in proximity to the inner activation sensor, the inner activation sensor located on an inner surface or in proximity of the bathroom stall door;

wherein, upon the outer activation sensor sensing a presence of a person in proximity to the outer activation sensor, the control unit commands the motor to rotate the gravity hinge to a first position to drive open the door and rotate the gravity hinge to a second position to automatically close the door after a predetermined time period;

wherein, upon the inner activation sensor detecting a person in the stall, the control unit activates the automatic door lock mechanism and locks the door;

wherein, upon the inner activation sensor senses a presence in proximity of the inner activation sensor a second time, the control unit commands the door lock to unlock the door and the motor to rotate the gravity hinge to the first position to drive open the door.

2. The apparatus for automatically opening a closing a bathroom stall door according to claim 1 wherein the stall door is positioned in a cracked-open position when the stall is vacant.

3. The apparatus for automatically opening a closing a bathroom stall door according to claim 2 wherein, after a predetermined time, a person is not sensed within the stall after the outer activation sensor senses a presence of a person in proximity to the outer activation sensor and the door is opened, the door returns to the cracked-open position indicating vacancy.

4. The apparatus for automatically opening a closing a bathroom stall door according to claim 1 further comprising means for manually locking and unlocking the stall door.

5. The apparatus for automatically opening a closing a bathroom stall door according to claim 1 further comprising an indication display, the indication display automatically displaying an occupied indication when the bathroom stall is occupied.

6. The apparatus for automatically opening a closing a bathroom stall door according to claim 1 further comprising means for manually opening and closing the stall door.

7. The apparatus for automatically opening a closing a bathroom stall door according to claim 1 wherein the control unit deactivates the outer activation sensor when the bathroom stall is occupied.

8. The apparatus for automatically opening a closing a bathroom stall door according to claim 1 wherein the control unit deactivates the inner activation sensor when the bathroom stall is vacant.

9. The apparatus for automatically opening a closing a bathroom stall door according to claim 1 wherein the control unit periodically hibernates for a predetermined time.

10. The apparatus for automatically opening a closing a bathroom stall door according to claim 1 further comprising a communication module coupled to the control unit, the communication module communicating with an external terminal to provide a status of the bathroom stall.

11. The apparatus for automatically opening a closing a bathroom stall door according to claim 1 wherein the door is attached to the stall with a plurality of hinges, wherein the plurality of hinges provide an electrical connection for supplying power to the motor and control unit.

12. A system for automatically opening and closing a bathroom stall door, the system comprising:

a bathroom stall having a door;

a gravity coupled slanted hinge for driving the door open or closed;

wherein the gravity hinge forces the door to open or close due to gravity and position of the gravity hinge;

a motor for rotationally position the gravity hinge for opening and closing the door;

a door lock attached to the door for preventing entry of the stall from outside the stall with automatic actuator;

a control unit for controlling the motor and door lock;

an outer activation sensor for sensing a presence of a person in proximity to the outer activation sensor, the outer activation sensor located on an outer surface of the bathroom stall door; and an inner activation sensor for sensing a presence of a person in proximity to the inner activation sensor, the inner activation sensor located on an inner surface of the bathroom stall door;

wherein, upon the outer activation sensor sensing a presence of a person in proximity to the outer activation sensor, the control unit commands the motor to rotate the gravity hinge to a first position to drive open the door and rotate the gravity to a second position to automatically close the door and lock the door lock if a person is detected inside the stall;

wherein, upon the inner activation sensor sensing a presence in proximity of the inner activation sensor for the second time, the control unit commands the door lock to unlock the door lock and the motor to open the door.

13. The system for automatically opening a closing a bathroom stall door according to claim 12 wherein the stall door is positioned in a cracked-open position when the stall is vacant.

14. The system for automatically opening a closing a bathroom stall door according to claim 13 wherein, after a predetermined time, a person is not sensed within the stall after the outer activation sensor senses a presence of a person in proximity to the outer activation sensor and the door is opened, the door returns to the cracked-open position.

15. The system for automatically opening a closing a bathroom stall door according to claim 12 further comprising means for manually operating the stall door.

16. The system for automatically opening a closing a bathroom stall door according to claim 12 further comprising an indication display, the indication display automatically displaying an occupied indication when the bathroom stall is occupied.

17. The system for automatically opening a closing a bathroom stall door according to claim 12 further comprising a communication module coupled to the control unit, the communication module communicating with an external terminal to provide a status of the bathroom stall.

18. The system for automatically opening a closing a bathroom stall door according to claim 12 wherein the door is attached to the stall with a plurality of hinges, wherein the plurality of hinges provide an electrical connection for supplying power to the motor and control unit.

19. The apparatus for automatically opening a closing a bathroom stall door according to claim 1 wherein a user may manually override automated operation for opening or closing of the door.

20. The apparatus for automatically opening a closing a bathroom stall door according to claim 19 wherein automatic operation for opening or closing the door is reestablished when the user terminates manual operation of the door.

* * * * *